United States Patent [19]

Langloy

[11] 4,327,944

[45] May 4, 1982

[54] TONGS DESIGNED TO LIFT AND HANDLE METAL SHEETS AND SIMILAR MATERIALS

[76] Inventor: Charles Langloy, 24 Rue Claude Farrere, 69003 Lyon, Rhone, France

[21] Appl. No.: 101,558

[22] Filed: Dec. 7, 1979

[30] Foreign Application Priority Data

Dec. 8, 1978 [FR] France ..... 78 35291
Mar. 30, 1979 [FR] France ..... 79 08585

[51] Int. Cl.[3] ..... B66C 1/48
[52] U.S. Cl. ..... 294/101; 294/104
[58] Field of Search ..... 294/86 R, 101, 103 R, 294/104, DIG. 1, DIG. 2; 24/248 R, 248 B, 248 E, 250

[56] References Cited

U.S. PATENT DOCUMENTS

| | | | |
|---|---|---|---|
| 2,360,601 | 10/1944 | Waldrup | 294/104 |
| 2,647,007 | 7/1953 | Gmoser et al. | 294/104 X |
| 3,071,406 | 1/1963 | Lucker | 294/104 |
| 3,189,377 | 6/1965 | Gardner | 294/101 |
| 3,441,308 | 4/1969 | Gardner | 294/101 |
| 3,857,600 | 12/1974 | Hasegawa | 294/101 X |

*Primary Examiner*—Johnny D. Cherry

*Attorney, Agent, or Firm*—Remy J. VanOphem

[57] ABSTRACT

A clamping device for handling and lifting metal sheets is disclosed. The device has a body member with a first flanged portion and a second flanged portion mounted adjacent to the first flanged portion. The first and second flanged portions define an opening therebetween for receiving metal sheets therebetween. A cam member includes an adjustable grip portion and an opposite leg portion. The cam member is attached to the first flanged portion so as to permit the adjustable grip portion to rotate in the opening from a first open position to a second closed position. The cam member is biased to a closed position by a helical spring member acting on the opposite leg portion. The spring member is supported on the other end by the body member and coiled about a pivot pin. The cam member is automatically locked in an open position by a lever engaging a pin on the cam member adjacent the adjustable gap portion. One leg of the lever arm extends through the opening between the two flanged portions. When the upper edge of the sheet metal engages the leg, the lever releases the pin on the cam member and the adjustable gap portion rotates to clamp the metal sheet.

18 Claims, 19 Drawing Figures

TONGS DESIGNED TO LIFT AND HANDLE METAL SHEETS AND SIMILAR MATERIALS

BACKGROUND OF THE INVENTION

The present invention pertains to a set of tongs, that are designed for the handling and lifting operations of metal sheets and plates.

Usually, this type of tongs includes a yoke, which is equipped with a prehensile device. The yoke includes two branches, both of which include a jaw, that is a fixed jaw and a mobile jaw formed in the profile of a swiveling cam, which may be spring actuated.

The handling operation of a metal sheet is made possible by the grip formed by the jaws of the tongs. With the present devices, the release of the metal sheet may create some problems, particularly when a tight, efficient grip is desired.

SUMMARY OF THE INVENTION

The present invention aims at obtaining an improved set of lifting tongs, which would include a simplified gripping mechanism, along with the necessary equipment to allow for the safe release of the metal sheet, as well as the required tightening of the sheet, regardless of its thickness.

According to the invention, the lifting tongs designed for the sheet metal handling and lifting operations include a yoke, which is equipped with a gripping device, along with a leg supporting a swiveling cam. The cam is controlled by a return device and constitutes the mobile jaws of the tongs. This cam also includes a second, adjustable leg which is part of the yoke and supports the fixed jaws. A control lever is also provided on the tongs for the release of the cam. This lever moves vertically. The tongs are equipped with elastic return devices, as well as locking and strengthening devices. The tongs also include a mechanism consisting of a component which is joined to the yoke, and whose first portion defines a locking hook for the cam, interacting with a recess provided on one or both sides of the cam; the second portion of this component defines a lever arm, which extends through the upper part of the space between the jaws, so as to permit the tightening of the cam by use of the control lever, or by the action of the metal sheet upper edge, to which the tongs are engaged. The yoke also includes attaching means for the various, detachable pieces of equipment.

According to a first type of construction, the mobile jaws swivel under the action of a compression spring, which is fastened to the body of the tongs, and part of a neutral override mechanism.

According to another preferred construction mode, the return mechanism of the cam is formed of an helical draw spring, which winds around the swiveling axis of the cam. One end of the spring is rigidly mounted on the fixed leg of the yoke, and the other end of the spring on the back of the cam, whose only stable position is the tightening position, due to the action of the return spring.

The first construction, including a compression spring and neutral override, is characterized by the following specification. The clamping area of the fixed jaw consists of a floating grip, which is mounted through a blind hole in the adjustable leg, and moves vertically.

According to another specification, the cam's actuating and release mechanism includes a compression spring, which is housed in a recess formed in two separate parts with the spring coiled around a central, telescopic rod in the recess.

This mechanism is of the so called "neutral override" type. The neutral point represents an unstable balance point wherein the rotating axis of the cam (mobile jaw), the pivoting axis of the spring and the pivot point of the control handle (or similar), and the opposite end of the compression spring, are in alignment. In addition, the release handle and the spring are oriented in a horizontal position. Thus, the operation can override the neutral point at the best possible positions.

According to another specification, the yoke of the tongs is formed of two identical flanges are, adjacent to the other and including a recess. The recess has a boss designed for the mounting and positioning of the adjustable jaw and of the swiveling cam, which constitute the mobile grip. The tongs also include a stop groove, whose length and profile are calculated so as to fulfill the following requirements. The clamping torque of the cam, on the metal sheet, should always be sufficient and increase in direct proportion of the thickness of the sheet to be lifted. The thickness of the sheet metal may vary between a minimum and a maximum values which are determined for a given position of the fixed jaw. The spring cup or "housing" should never stop against the actuated cam, which locks automatically by means of the compression spring's handle.

According to another specification, the cam actuating and locking system, by means of a swiveling hook, allows the automatic release of the cam as the metal sheet is engaged between the jaws, and for the tightening of the tongs on the sheet, by automatically clamping the mobile jaws which are positioned in the air-gap.

According to another specification, the sheet metal can be released by pulling the compression spring handle downward. This operation may be remotely controlled by using a cable for instance.

According to another specification, the grip of the fixed jaw is mounted a ball and socket joint to permit the metal sheet to be easily engaged in the air-gap of the tongs.

The second construction mode of the tongs, with a coiled helical spring, includes the following specifications.

The lower cross-profile of the back part of the cam includes some protruding parts located along the guide of a lever, which is hinged along the same axis as the cam. The lever is returned upward by another helical traction spring which is used to return the cam in storage position when pushed downward.

According to another specification, the locking and actuating system of the cam consists of a pivoting lever, equipped with an helical return spring, which interfaces with a piece rigidly mounted on the cam, so as to operate as a hook.

The advantages of this type of construction should be noted. The return mechanisms are simplified. When pushed downward, the storage lever provides the release of the metal sheet, as well as the actuation of the tongs, in a single operation.

According to another specification, the helical traction springs used for the return of the cam, or mobile jaw, of the storage or release lever and of the locking arm or lever, respectively have one end supported by a pin or similar piece. This pin is rigidly mounted to the leg of the yoke, whereas all of the springs and the tongs of the swiveling assembly are located between two lateral flanges forming the leg, which thereby protects the mechanism against impact (when the tongs are dropped for instance).

According to another specification, the return spring of the cam release lever is positioned in such a way that an effort opposite to that of the return spring is required to release the metal sheet. This operation is therefore a positive control, since the lever comes to rest directly against an external shape of the cam, which is thereby released regardless of the elongation or taring of its helical spring.

Finally, and notwithstanding the type of construction of the tongs according to the invention, the following advantages and technical improvements should be noted.

The yoke adjustable leg supporting the fixed jaw can either be adjusted on several positions which respectively define a different air-gap width between the jaws, or can be replaced by a similar leg. The pivoting lever used to lock the cam defines a hook, which may be released through the action of the metal sheet to be clamped, and which causes it to automatically swivel. The end of this arm or lever extends through the air-gap.

The levers used for the manual actuation of the cam and of the tongs, as well as the locking lever of the cam or the tong release lever (the cam being either actuated or released), move downward and may be operated by remote control.

The moving parts of the tongs are always protected by the heavy parts, which constitute the yoke. The yoke includes two side flanges, between which the clamping mechanism is located.

The operation of the tongs is simplier and easier than that of the popular tongs. In particular, the cam (mobile jaw) is almost always engaged.

BRIEF DESCRIPTION OF THE DRAWINGS

The attached, schematic drawings give a better understanding of the specifications and practical advantages of the invention.

DETAILED DESCRIPTION OF THE PREFERRED EMBODIMENTS

Figure 1:
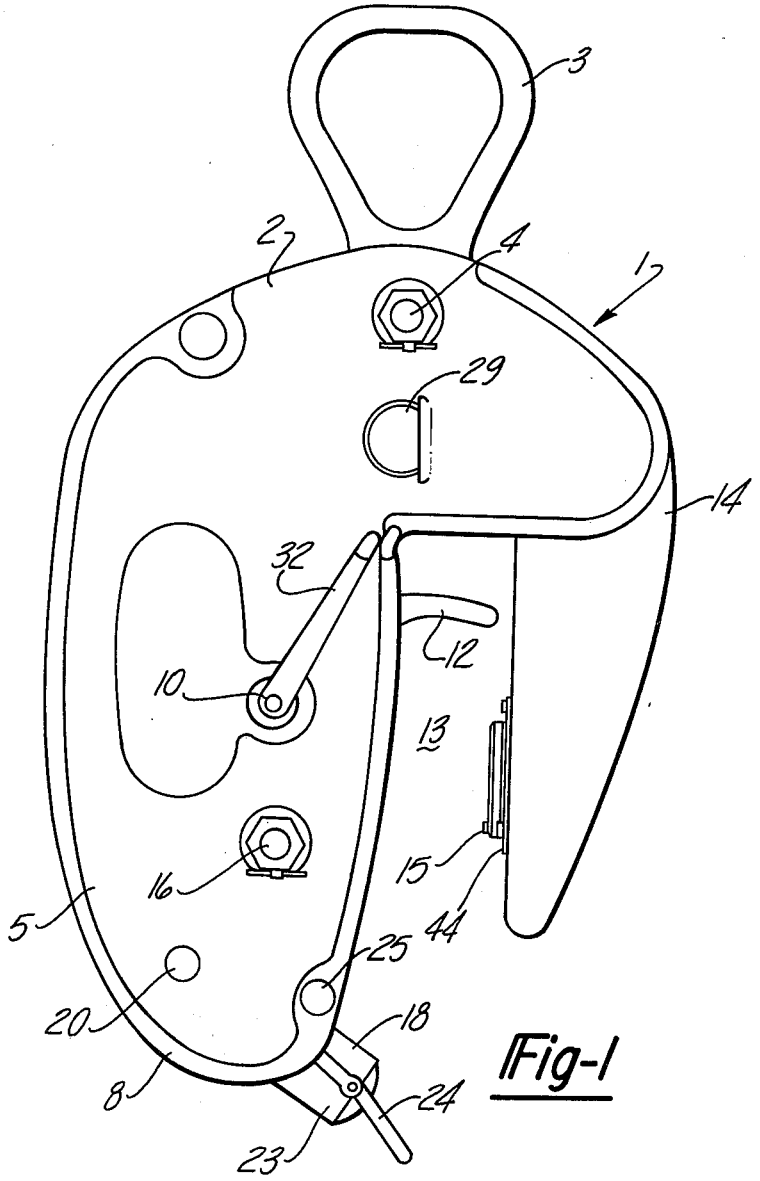
FIG. 1 is a plan view of a set of tongs according to the invention, of the neutral point and compression spring type.

FIGS. 1 through 10 illustrate a first type of tongs accordling to the invention. According to this type of construction, the tongs 1 include a body or yoke 2 equipped with a lift ring 3, pinned in 4. The yoke 2 includes a jaw 5, which consists of two semiflanges 6 and 7. Both flanges are relatively thin but are reinforced by the grooves 8. The grooves 8 are formed on at least part of the circumference of each flange.

Holes are provided in each flange so as to allow the pinning of a swiveling cam 9 (FIGS. 3 and 4), which constitutes the tightening mobile grip of the tongs. The body 2 includes likewise: The pivot pin 10 of a hook 11, which may be controlled by an arm 12 extending through the air-gap 13 between the jaw 5 and an adjustable jaw 14. The adjustable jaw receives the so-called fixed tightening grip 15, the mobile or adjustable grip portion or cam 9 being mounted so as to swivel around a pin 16 supported by the flanges.

Figure 10:
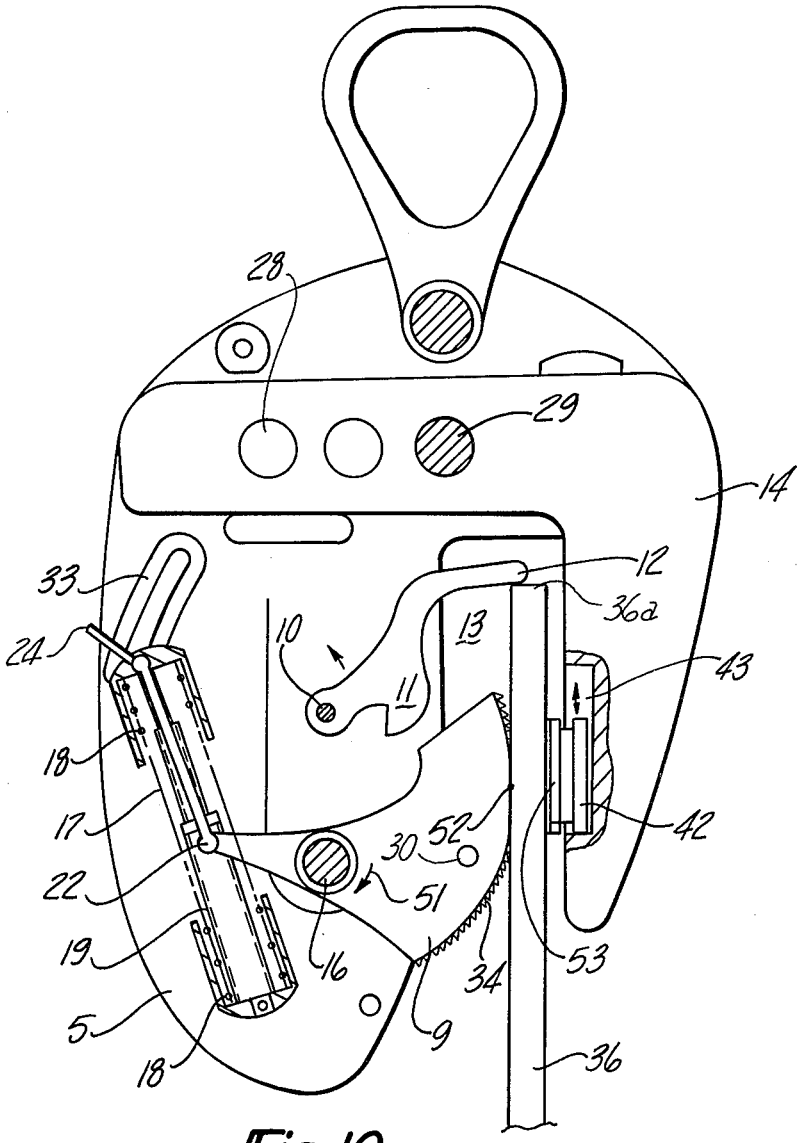

A return mechanism includes a compression spring 17 which is located in a housing 18 consisting of two detachable parts. The spring is mounted around a central, telescopic rod (or similar) 19 as shown in FIG. 10. The return mechanism is joined to the yoke at 20 and connected by a double ended link 21, with one end attached to the rear tip of the cam 9, where it is pinned at 22. The link 21 is connected at the other end 23 to the end opposite to the joint 20 of the housing on the yoke. Finally, an operating device such as a handle 24 is rigidly mounted to the free end of the housing.

A stop pin 25 against which the housing 18 stops is also used as a connection means between the flanges 6 and 7.

The flanges 6 and 7 include bosses and recesses defining a housing which may have a rectangular cross-section; the housing 26 is adjacent a face 27 of a jaw 14 which includes several openings, such as at 28. The openings are to receive mounting pins 29 used to position jaw 14 with reference to yoke 2 (FIGS. 2 and 3); and an internal recess formed between flanges 6, 7 makes provisions for the motion of cam 9, and for mounting the return mechanism, the link 21 and the hook 11.

Figure 4:
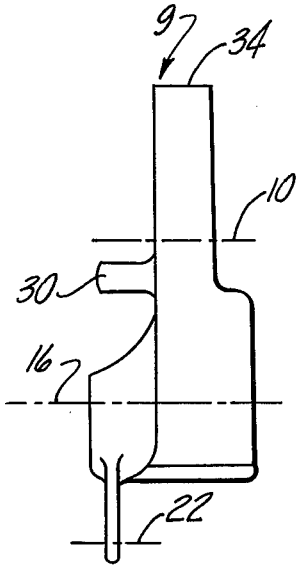
FIG. 4 shows the outside of the cam (mobile jaw), seen edgewise.
Figure 2:
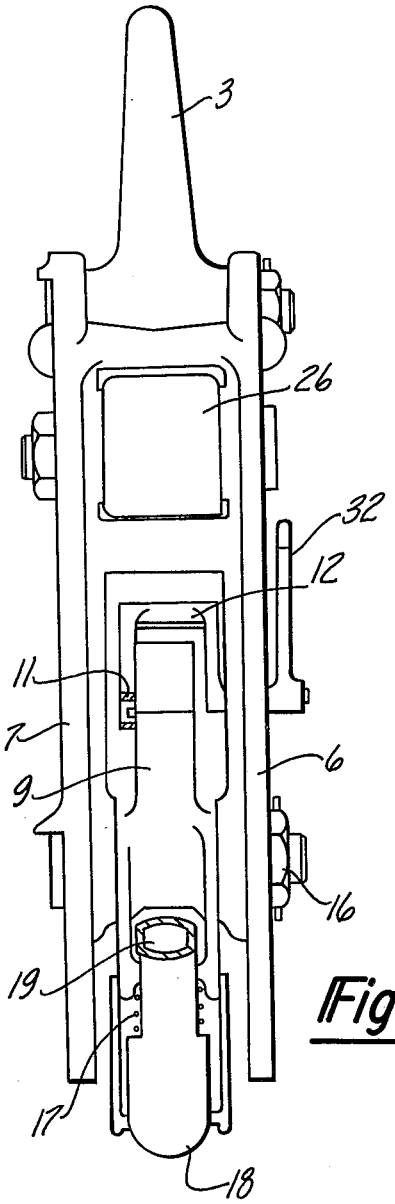
FIG. 2 is a side view, excluding the adjustable jaw on the body.
Figure 3:
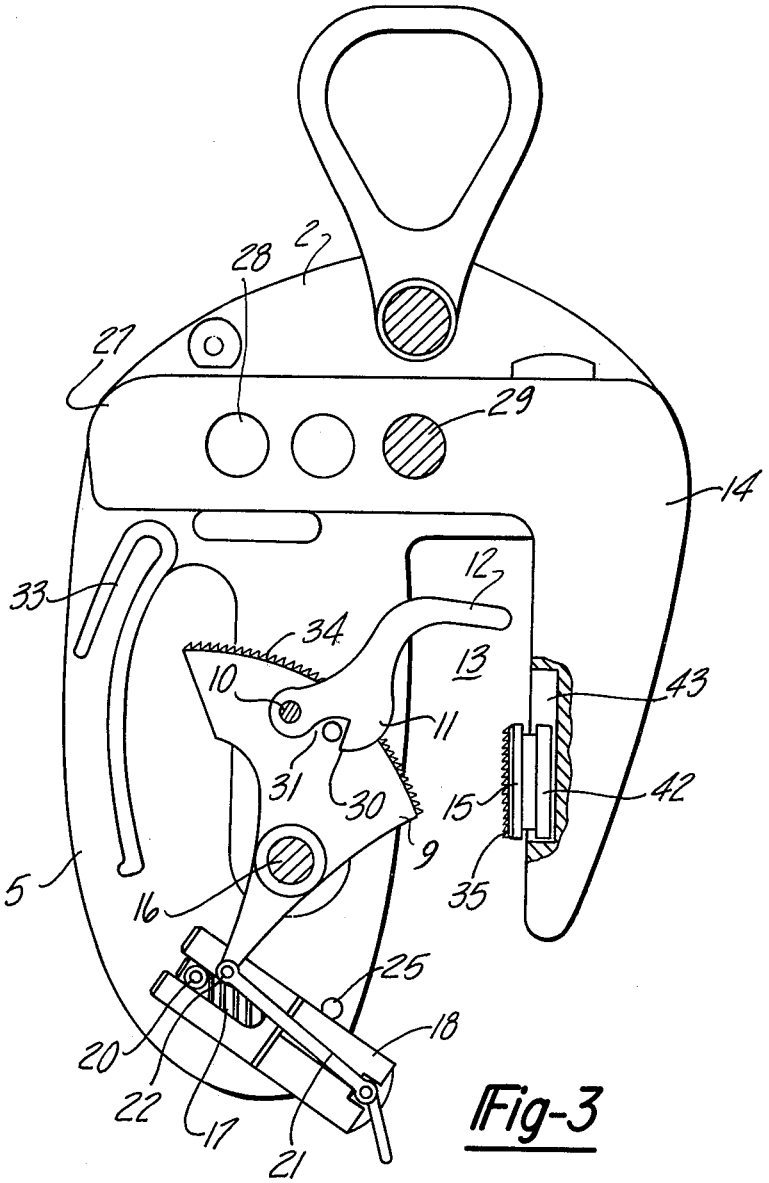
FIG. 3 shows the mechanism connected to the mobile cam, with a partial cross-section of the floating grip, or fixed jaw.

FIGS. 3 and 4 illustrate the profile of cam 9, as well as the respective positions of the cam and of the hook 11. A lug 30 is provided on one side of the cam. The recess 31 in the hook engages the lug 30 to lock the cam in position. Moreover, this locking action is automatically obtained by gravity and downward motion of the lever arm 12. Another arm or lever 32 is supported by one of the flanges and connected to pin 10. This lever provides for the manual control of the hook 11 (FIGS. 1 and 2).

A stop groove 33, defined by the dual flange assembly, offers a profile which is especially designed to offer a sufficient clamping effort between the cam profile 34 and the face 35 of grip 15 which constitute the two jaws.

Figure 8:
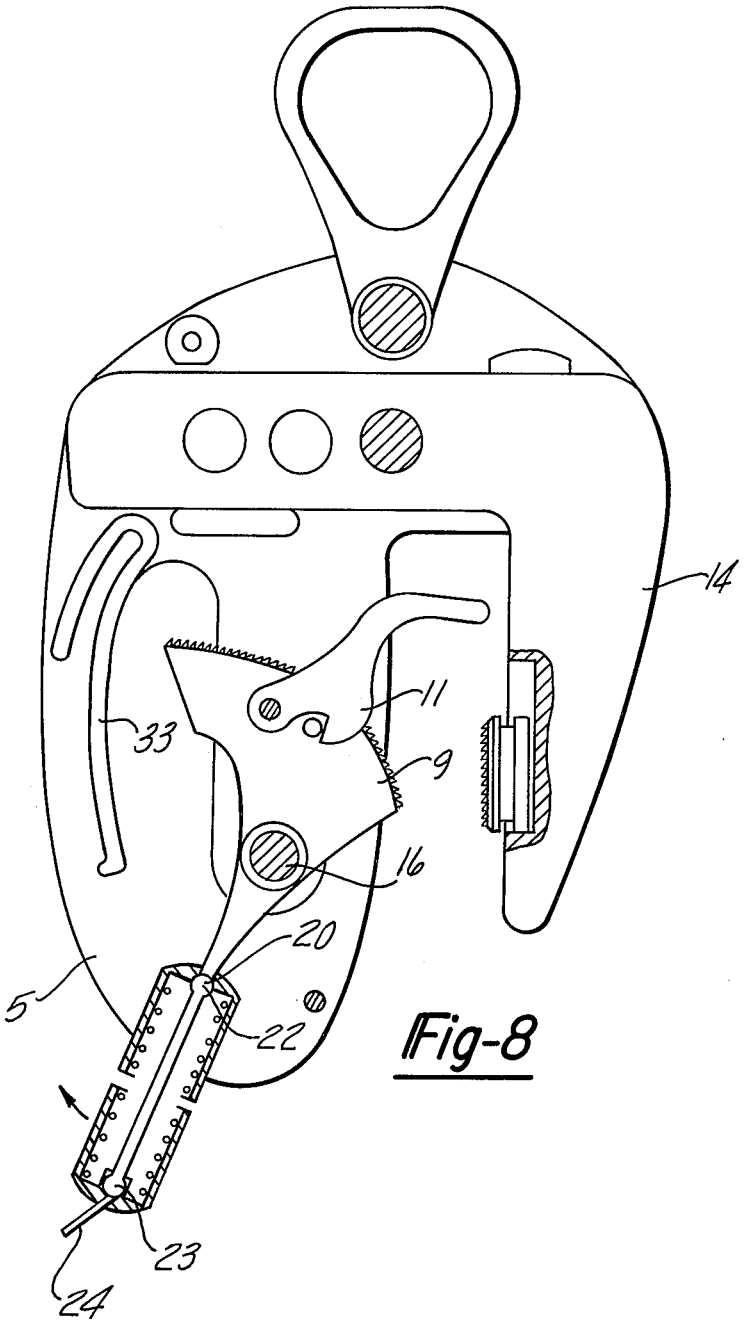
FIGS. 8, 9, and 10 illustrate various positions of the spring mechanism during the operation of the tongs shown on FIGS. 1 through 7, and equipped with a mobile grip with lock, and a compression spring with neutral override.
Figure 9:
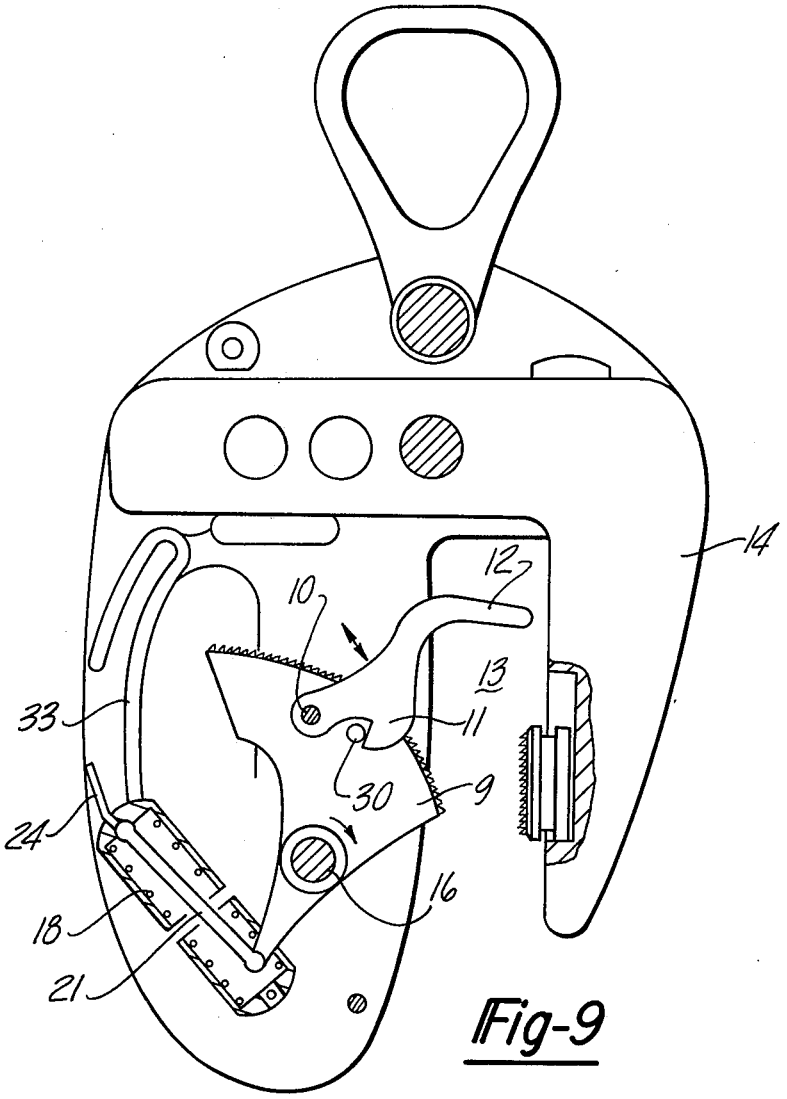

The spring return mechanism, including a compression spring, is of the so-called overcenter type. In FIGS. 1 through 3, the effort of spring 17 disengages the cam 9 inside the jaw 5. In FIG. 8, the spring is shown in an unstable or neutral position. In FIGS. 9 and 10, the spring acts to push the cam 9 into the air-gap 13 to clamp the metal sheet 36 located therein. FIG. 10 shows the cam 9 in the engaged position.

Figure 5:
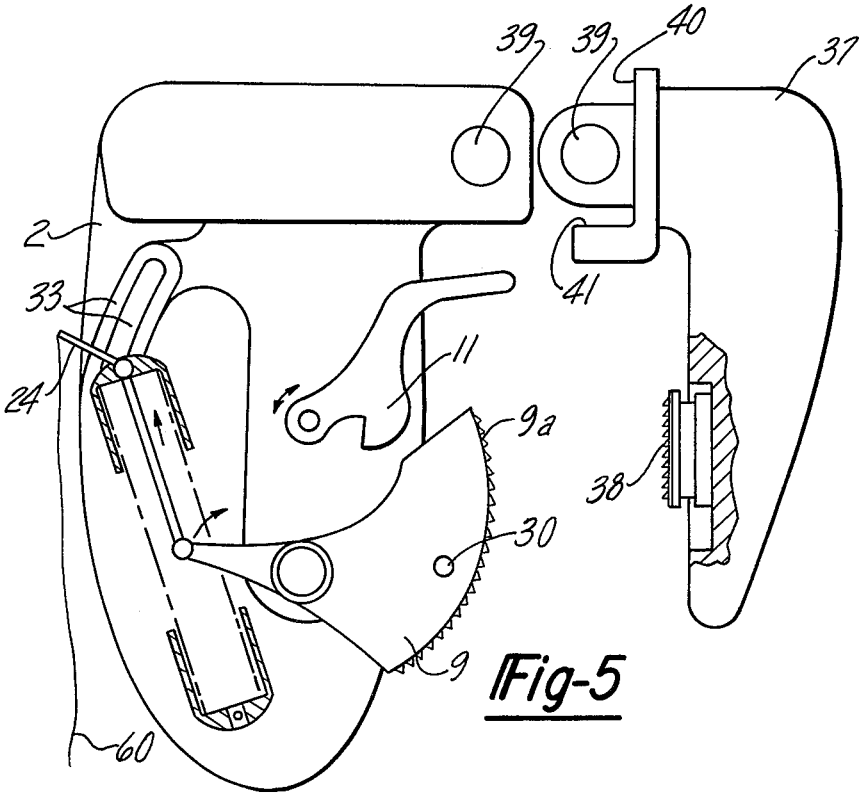
FIG. 5 illustrates a set of tongs that are equipped with interchangeable jaws.

FIG. 5 shows one variation of the adjustable jaw construction. The interchangeable jaw 37 includes a grip 38 which may be notched. The mounting of the jaw 37 to the yoke 2 is obtained by placing a pin in the holes 39. At this point, the faces 40 and 41 of the jaw 37 contact the respective faces of the yoke 2. These contacts represent reaction pieces against the clamping effort formed between the rotatable grip (notched) 9*a* and the slidable fixed grip 38.

Figure 6:
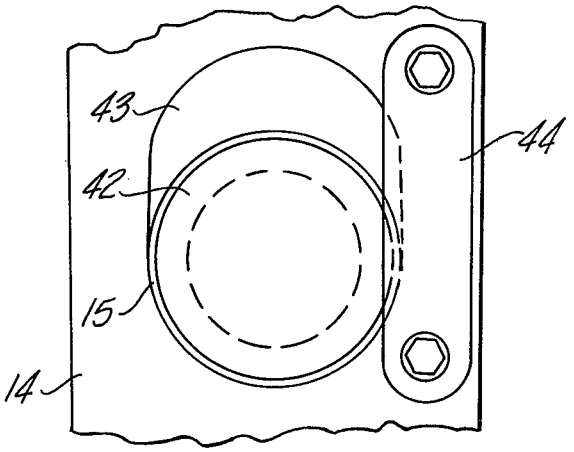
FIG. 6 illustrates the mounting of the fixed grip in a blind hole of the adjustable jaw.

As indicated in FIG. 6, the grip 15 of the adjustable jaw is mounted on a plate 42 which is housed in an elongated blind hole 43 provided in jaws 14 (FIG. 3) or 37 (FIG. 5). Plate 42 is held in position in hole 43 by a stop plate 44 which is screwed onto the internal face of the jaw. This assembly lets the grip move vertically along the jaw within the hole.

Figure 7:
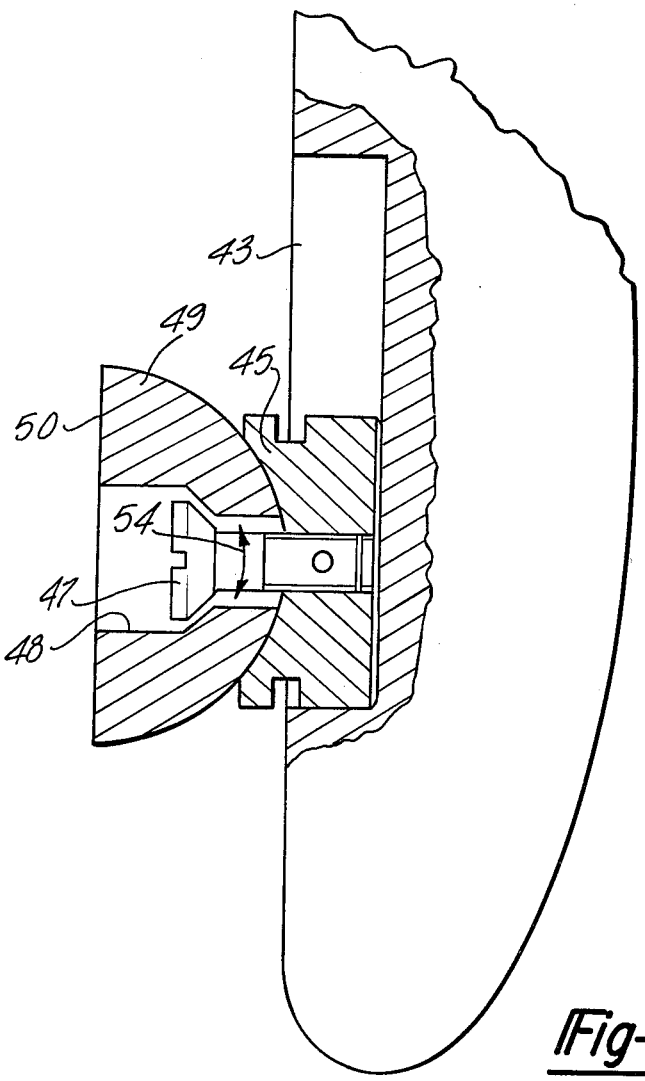
FIG. 7 is an enlarged view of another possible construction of the fixed grip.

FIG. 7 shows an enlarged view of a fixed grip 49 which is ball jointed on a plate 45. The plate 45 is mounted in an elongated hole, as previously explained. The threaded rod 47 is locked on plate 45. A gap remains between the head of the rod 47 and the bore 48 of the grip 49. This gap has been deliberately exaggerated in the Figure in order to clearly indicate that the grip 49 may slightly rotate around a theoretical axis which is that of the threaded rod 47 (as shown in the Figure); or associated with that axis. The clamping face 50 may pivot to ease the introduction of a metal sheet between the jaws.

The tongs are controlled and operate in the following manner:

An adjustable jaw 14 or interchangeable jaw 37 is mounted on the yoke 2, so that the air-gap 13 is compatible with the thickness of the metal sheets to be lifted.

The clamping faces (cam profile 34, fixed grip face 15) are selected, taking into account the roughness and hardness of the metal sheets.

The cam 9 is engaged by actuating handle 24. It is thereby possible to switch from a storage position as illustrated on FIGS. 1 through 3, to a triggered position which is automatically locked, as illustrated in FIG. 9. In order to obtain this mode of operation, the operator has to move the return mechanism to the unstable or neutral position illustrated in FIG. 8. The pins 16, 20 and 23 are then aligned, whereas the control handle 24 is practically horizontally oriented. By pulling upward, the operator actuates the apparatus, the clamping cam being locked in position by the hook 11. After reaching the neutral point illustrated in FIG. 8, the apparatus comes to the position illustrated in FIG. 9, automatically. The cam 9 is engaged but held within the outline of the jaw 5 by the locking device. The tongs are not engaged and the air-gap 13 remains free so as to receive the edge of a metal sheet.

It should be noted that, as soon as cam 9 is triggered, all of the compression spring return mechanism is pulled back between the two flanges 6, 7 forming jaw 5. Should the tongs 1 fall for any reason when empty, the shock is absorbed by the above flanges which protect the essential components of the tongs.

If cam 9 is locked when disengaged (FIG. 3), the spring assembly rotates, during the engagement operation, around the joint 20; the link 21 is joined to the fixed pin 22. The construction is such that, in a locked position, both pins 20 and 22 are superposed. They have been purposefully identified separately on the drawings in order to provide a better understanding of the construction.

In order to obtain better protection of the spring and its handle, it would be obviously possible to position the pins 16, 20 and 23 in such a manner that, as soon as the neutral point is reached (FIG. 8), the return mechanism cannot extend below the jaw 5.

From the engaged or triggered position of the cam 9 as shown in FIG. 9, the tongs provide for the automatic release of the cam and clamping by the tongs, which automatically induces the tightening of the metal sheet. It is therefore sufficient to engage the tongs 1, through their air-gap 13, on a metal sheet 36 whose edge 36*a* hits the arm 12 and pushes the arm upward. The hook 11 pivots around its pin 10 and moves upward, thus releasing the lug 30 of the gripping cam. The compression spring then extends by sliding along stop groove 33. The connection between the link 21 and the bottom of the cam 9 induces the rotation of the latter around its pin 16, in the direction of clamping as indicated by arrow 51 in FIG. 10. The cam's profile enters the air-gap 13 and provides, through the power of spring 17, the tightening of the metal sheet, by clamping it between the mobile grip (profile 34 of cam 9) and the fixed grip (15).

Through its ability to move vertically in the blind hole 43 of the adjustable jaw, the mobile grip permits, as the tongs are engaged on the metal sheet, the automatic alignment of the clamping points 52 and 53 on either side of metal sheet 36 with the pin 16 of the swiveling cam. It is indeed in that position that for a given clamping effect, the effort is the least on either face of the metal sheet. It is therefore possible to use the tongs described in the invention, to lift a heavy metal sheet with polished faces, without damaging these faces (FIG. 10).

The use of a ball jointed grip (FIG. 7) assists the engagement of the tongs on the metal sheet. Since the clamping surface may rotate following the double arrow 54, the lower edge of surface 50 will come closer to the internal face of the jaw 14, so as to allow a larger width of the air-gap entrance.

The telescopic rod 19 and the dual housing 18 prevent the buckling of the compression spring 17.

As the cam 9 is disengaged, that is when it is brought back to its stable storage position as illustrated on FIG. 3, the tongs described in this invention offer several advantages: The disengagement of the cam requires the return mechanism to be moved downward (FIGS. 9 and 10), so that this operation may be remotely controlled, using, for instance, a simple cable 60 (FIG. 5) which is connected to the control handle 24. This is a definite advantage when handling large metal sheets that are three meters high and over.

Several noted positions are shown, starting with that of FIG. 10 in which the tongs are loaded with the metal sheet.

By pulling the handle 24 downward, the position obtained is that of FIG. 9. The cam 9 is engaged by the hook 11 and the tongs are unloaded. The external profile of hook 11 allows the automatic lock of the cam in the stored position. If the handle is released after releasing the metal sheet, the cam remains engaged and locked in that position.

When proceeding with the cam disengagement operation, the positions illustrated in FIG. 8 (neutral) and FIGS. 1 through 3 (return in storage position of the cam) are successively reached. The cam remains locked with the lever 12 throughout these operations. The lock is automatic (the lever 12 is no longer pushed by the metal sheet which has been released), and the release can only be obtained manually, using the control lever 32 mounted on the yoke (FIGS. 1 and 2).

The type of construction described above represents a non-exhaustive example. It should be noted that, compared with similar tongs, that is with two stable positions return mechanism and neutral override, the tongs described in the invention offer important practical advantages described below:

The loading operation of the tongs may be automatically controlled by the upper edge of the metal sheet to be clamped.

The type of construction which includes a fixed grip supported by a detachable and adjustable leg reduces the cost of the tongs, as well as the efforts to which they are subjected.

The cam, whether engaged or disengaged, is automatically locked and can be unlocked by remote control, in the same way as the unloading of the tongs. The control levers are moved downward.

FIGS. 11 through 19 illustrate a simplified type of construction of the tongs and incorporate the main features of the invention. Furthermore, this type of construction allows for the safe release of the metal sheet, regardless of the clamping effect resulting from its handling.

Figure 11:
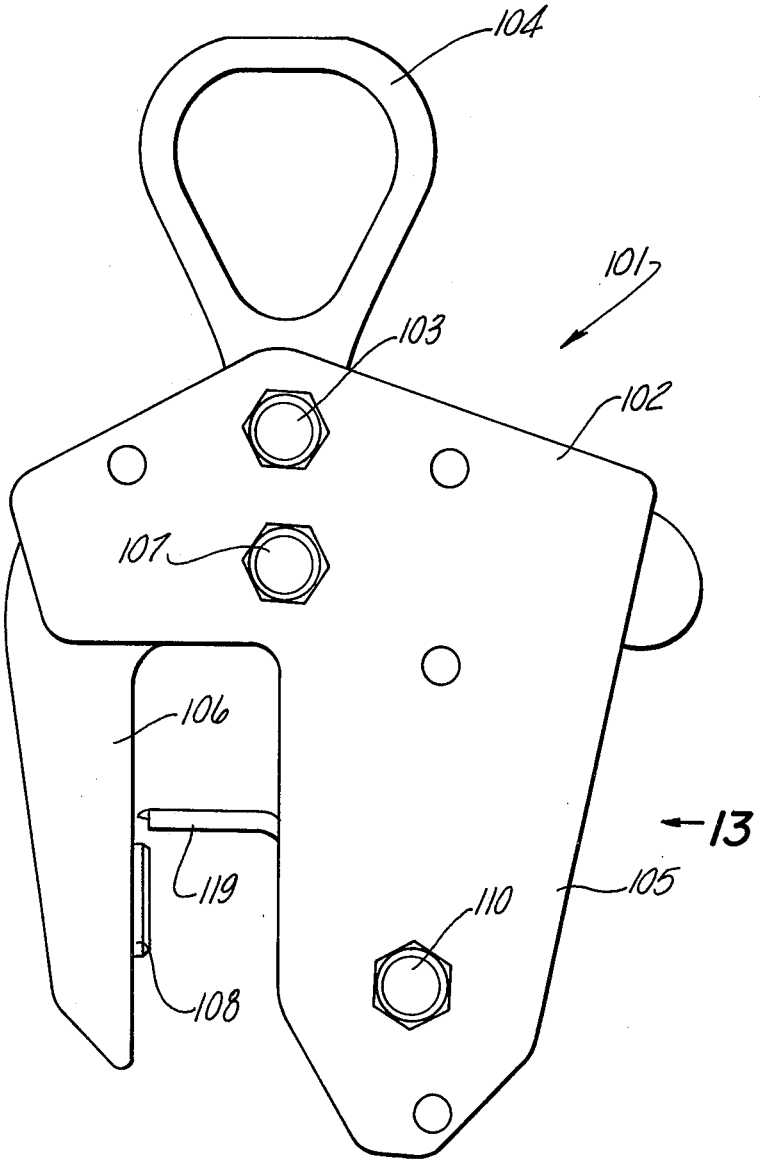
FIG. 11 is a plan view of the tongs according to the invention, with coiled helical springs.

According to the type of construction as shown in FIGS. 11 through 19 the tongs 101 whose yoke 102 is equipped with a lift ring 104 pinned to the yoke at 103, include a leg 105 which is rigidly mounted to the yoke, whereas another leg 106 is adjustably mounted in the yoke by a pin 107 (FIG. 11).

Figure 13:
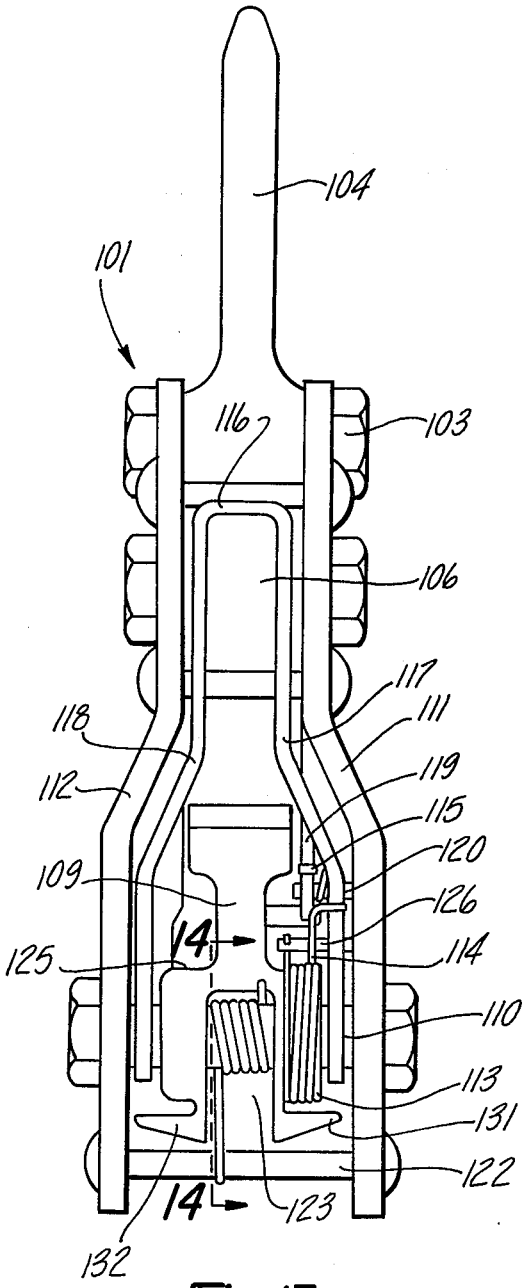
FIG. 13 is a side view in the direction of arrow 13 of FIG. 11.

The leg 106 may carry a grip 108 which represents the fixed jaw of the tongs. The other jaw is a mobile one and is represented by a cam 109 which may pivot around a pin 110 supported by the leg 105. The leg 105 consists of two flanges 111 and 112 (FIG. 13). The cam 109 has a profile **109*a*** which may be notched.

The tongs are equipped with elastic return means represented by helical traction springs 113, 114 and 115 which activate the swiveling cam or mobile grip 109 and a U-shaped lever 116 which is fastened to the cam rotation pin 110. The lever 116 can be moved downward to counterbalance the effort furnished by the spring 114, thereby pushing back the cam 109 with the legs 117 and 118, to counterbalance the effort furnished by the spring 113; the advantages offered by this construction are discussed hereinafter. The cam lock lever 119 which is fastened to the yoke pin 120 is also activated by the above helical traction springs.

Figure 14:
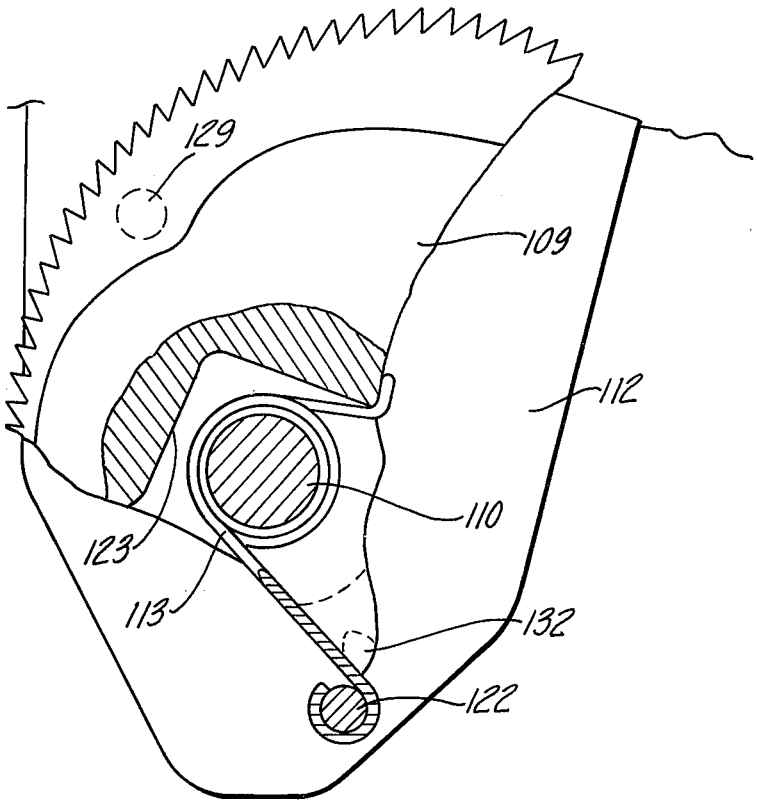
FIG. 14 is a view of the swiveling cam equipped with its return spring along section 14—14 of FIG. 13.

The springs 113, 114 and 115 are helically coiled around cross-shafts or cross-pieces, as shown on FIG. 13. They are positioned in such a way that, in FIG. 12, the cam 109, the lever 116 and the arm 119 are returned to the left, that is toward the air-gap 121 defined by the space between the faces, with reference to the legs 105 and 106 of the tongs. One end of spring 113 is fastened to the lower cross-piece 122 of the yoke, whereas the opposite end is fastened to the back of a U-shaped recess 123 provided in the cam 109 (FIGS. 13 and 14). Thus, the cam is always returned in clamping position, following the arrow 124.

Figure 15:
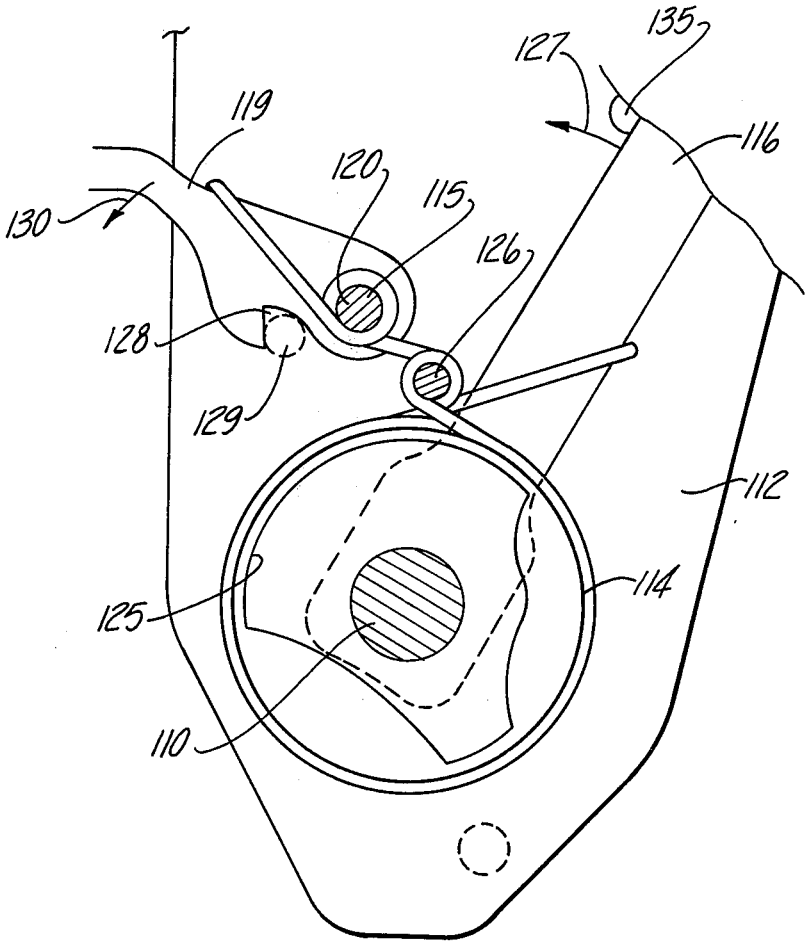
FIG. 15 shows a view of the mounting of the lock and storage levers of the cam (tongs illustrated in FIGS. 11 through 14).

FIGS. 13 and 15 show the arrangement of springs 114 and 115. The helical part of spring 114 is coiled around a side boss 125 of the cam 109. One of its ends is fastened to a lug 126 which is rigidly mounted to the flange 112. The other end is pushed back behind the storage control lever 116 which is thus returned in the direction indicated by arrow 127 (FIG. 15). The spring 115 is fastened to the lug 126, coiled around pivot 120, and pushed back behind the arm 119 whose lower edge includes a recess 128 allowing the lever 119 to act as a lock hook for the cam 109 which includes a side boss 129 designed to be engaged in recess 128. Arranged in such a manner as shown in FIG. 15, the spring 115 returns the lever 119 in the direction indicated by arrow 130, the end of said lever extending through the air gap 121 of the tongs (FIGS. 11 and 12).

Figure 16:
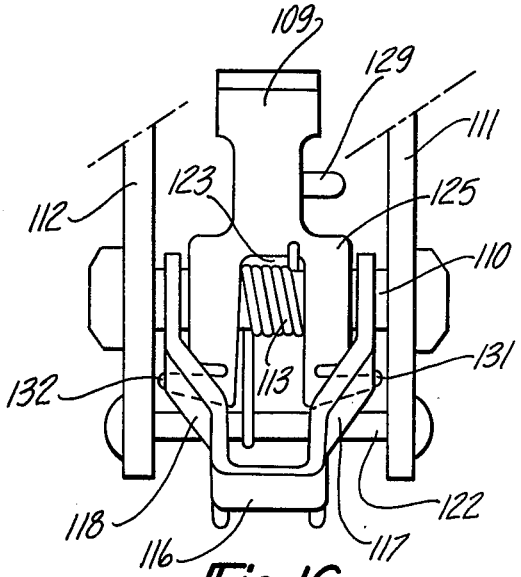
FIG. 16 is a side view of the preferred construction of the cam, and of its lock and storage lever.

It has been previously indicated, the operation of lever 116 downward controls the release of the metal sheet clamped in the tongs, by disengaging the cam 109. This result is obtained by the tongs of the invention by using the U-shaped lever 116 whose legs 117 and 118 are fastened to the pivot pin 110, on either side of the cam. Furthermore, the cam's edge opposite to the profile (notched or not) and constituting the mobile grip, includes cross-bosses. These bosses 131 and 132 (FIGS. 13 and 16) are designed so as to be repectively placed on the ends of the legs 117 and 118 respectively. Therefore, a downward motion of the lever 116 brings the legs in contact with the back of the cam. As this effort exceeds the sum of the efforts furnished by the springs 113 and 114, the cam 109 swivels regardless of the power or taring of the springs, particularly of the spring 113 which is housed in the cam (FIGS. 13 and 14) since the storage control lever 116 directly activates the cam (FIG. 16).

Figure 12:
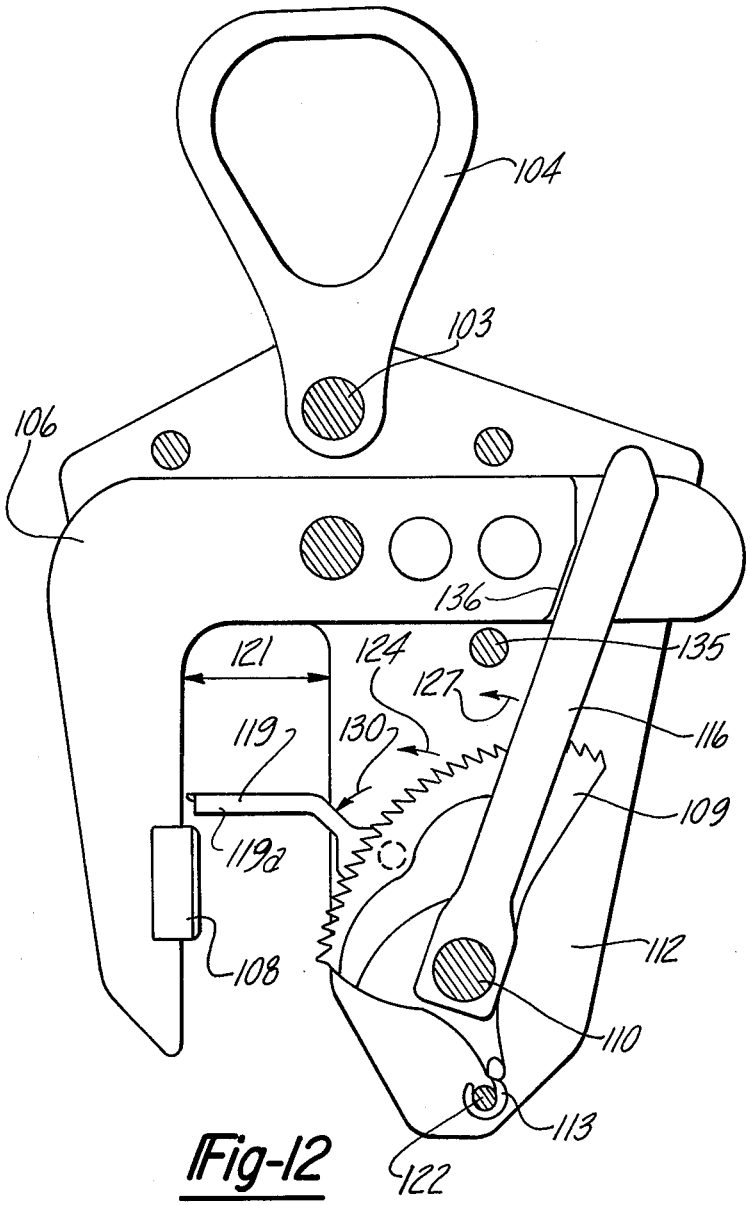
FIG. 12 shows a view of one possible construction of the tongs in which one flange has been removed from the yoke.
Figure 17:
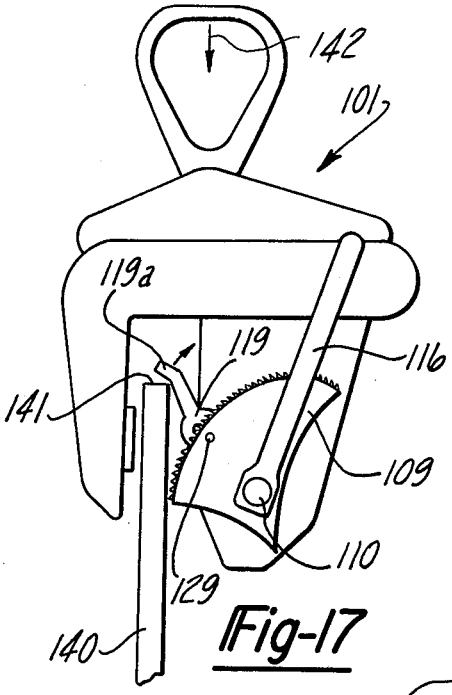
FIGS. 17, 18 and 19 illustrate various positions of the swivel mechanisms of the cam or mobile grip, and show the gripping, lifting and laying operations of a metal sheet, as performed by the tongs as illustrated in FIGS. 11 through 16.

The tongs, according to the invention, operate as follows:

As the tongs are triggered, that is when the cam 109 is disengaged and locked by the hook-lever 119, the cam 109 is subjected to the return effort of the helical spring 113, the tongs 101 are in the position illustrated on FIGS. 11 through 13. A first advantage of the invention is observed: the bulk of the tongs is reduced to a minimum, whereas all of the clamping mechanisms (jaws, levers, springs) are protected against accidental shocks by the solid pieces represented by the legs 106 and 105, as well as the side flanges 111 and 112. The internal end **119*a* of the hook-lever 119 extends through the air-gap 121 of the tongs. The tongs are then eased down on the upper edge of a metal sheet 140 which is to be lifted. The metal sheet 140 is then positioned in the air-gap 121 with its upper edge 141 adjacent to the end 119*a* of the arm 119. The tongs are eased further down (arrow 142) so that the metal sheet pushes the arm 119 upward, against the effort of spring 115 as shown in FIG. 17. As the arm 119 pivots around its pin 120, the recess 128 is lifted up and is pushed away from the boss 129 of the cam 109, as illustrated in FIG. 17**.

Figure 18:
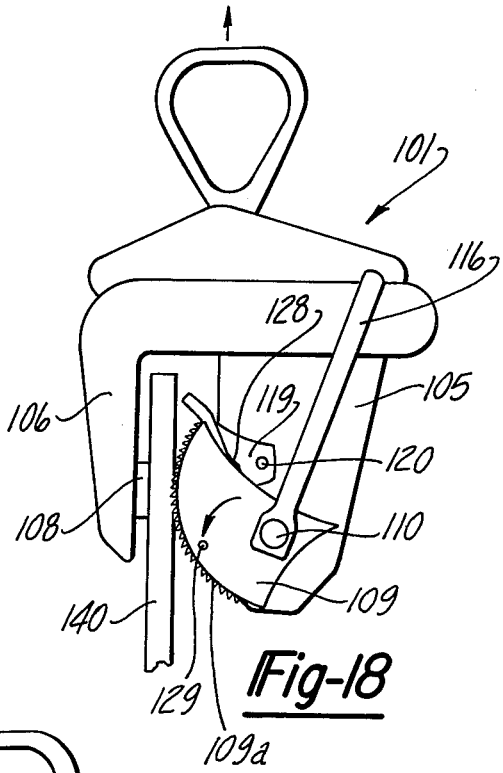

The mounting of spring 113 is such that the cam 109 of the tongs may be considered as being permanently engaged, that is retained in a clamping position. Therefore, as soon as the arm 119 has been pivoted enough to release the locking boss 129, the cam is pushed by its spring 113 inside the air-gap or recess 123, thus permitting the cam 109 to swivel around the pin 110 (FIG. 18). The profile 109*a* of the cam comes to rest against one of the faces of the metal sheet 140 whose opposite end is resting against the fixed grip 108. As the metal sheet is being lifted, the effort of the spring 113 and the weight of the metal sheet produces the clamping action of the tongs, between its fixed grip 108 and its mobile jaw 109. The construction illustrated in FIGS. 11 through 19 is simplified since the clamping mechanism includes only one pivot pin 110. The pin 110 engages the cam and the storage and lock control levers and permits the disengagement of the tongs.

Figure 19:
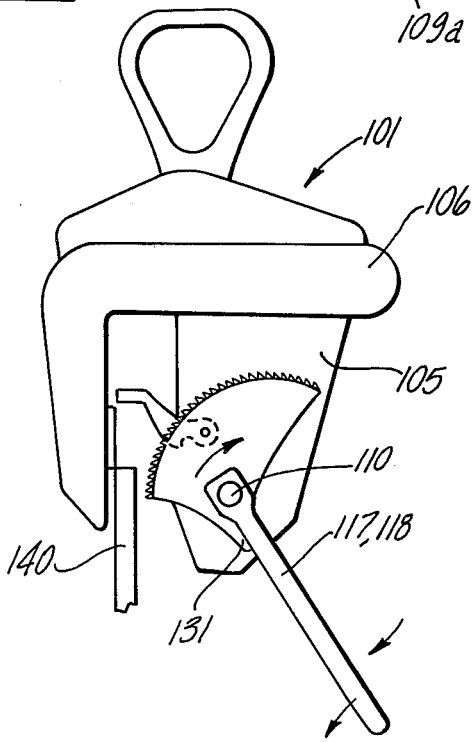

In order to disengage the tongs and release the metal sheet, it is necessary to release the swiveling cam by operating the storage control lever 116 downward, so as to make it rotate around pin 110. The tong disengaging operation is a so-called "positive" operation which allows the safe release of the metal sheet. Indeed, as illustrated in FIGS. 16 and 19, the lowering of lever 116 brings its legs 117 and 118 in direct contact with the bosses 131 and 132 provided at the back of the cam. If the lever 116 is further lowered, the cam swivels away from the fixed grip position and releases the metal sheet. The release is obtained regardless of the taring of springs 113 and 114. The lever acts directly on the cam and not on the spring. In the case where the clamping force is very high, the effort put on the lever should be increased. The lever may be manually or mechanically operated (the mechanical control is not illustrated), using a hoist or similar equipment. Besides a safe release, the control lever 116 offers the following advantages:

Since the operation is performed downward, the lever may be activated from the ground and from a remote distance, regardless of the height of the metal sheet to be lifted or handled. The control may be obtained by attaching a cable (or similar piece of equipment), not illustrated, to the top part of the lever.

A single operation allows the release of the metal sheet and the engagement of the tongs. The release of the cam 109, controlled by lever 116, allows the arm 119 to lock the cam 109 whose boss 129 engages the lock recess 128. A single downward motion of lever 116 releases the metal sheet and engages the tongs so that it is immediately ready to handle another piece of metal sheet.

The taring of the clamping spring 113 may be as high as desired, in order to guarantee a safe lift.

As illustrated on FIGS. 13 and 15, the lever 116 is returned upward, by the spring 114 during the initial phase of the tongs operational cycle. For instance, it may come to a stop against the boss 136 on the adjustable leg 106 (FIG. 12), or against a cross-pin 135 mounted on leg 105, as the air-gap is at its maximum. The pin 135 is, of course, positioned in such a manner that the lever 116 cannot hit the lug 126 or the pivot 120 (FIGS. 12 and 15).

The two types of construction illustrated on the drawings are only two examples. The invention would still cover modified tongs whose mobile grip is a cam with one or two stable positions, controlled by a return spring, a storage control lever and a locking device including an arm which extends through the air-gap, between the mobile and fixed grips, the latter being supported by an adjustable, detachable leg provided on the yoke of the tongs.

Among the advantages offered by the tongs designed according to the invention, the following should be noted:

A safer operation, along with a simplified mode for the engagement of a metal sheet, the engagement of both the cam and the tongs, by automatically locking the cam.

The fixed grip can be adjusted or replaced, depending on the proposed operation.

The moving parts are entirely protected by the flanges, and the space needed for the operation of the tongs is reduced to a minimum.

The storage and lock lever may be remotely controlled.

The metal sheet to be lifted and handled may be safely released.

I claim:

1. A clamping device for handling and lifting metal sheets, said device comprising:

a body member having a first portion and a second portion mounted adjacent to said first portion, said first portion having a first flange, said second portion having a second flange opposite but spaced away from said first flange; said first and second flanges defining an opening therebetween for receiving metal sheets therein;

a cam member rotatably mounted to said first portion, said cam member having an adjustable grip portion and a leg portion opposite said adjustable grip portion, said cam member further being attached to said first portion adjacent to said first flange so as to permit said adjustable grip portion to rotate in said opening from a first open position to a second closed position;

a lug mounted to said adjustable grip portion;

a lever arm pivotally mounted to said first portion, said lever arm having a notched portion, said notched portion further engaging said lug to lock said adjustable grip portion of said cam member in said first open position when said lever arm is rotated to extend into said opening toward said second flange; and means for disengaging said lug from said notched portion in said lever arm by rotating said lever arm away from said lug such that said adjustable grip portion on said cam member pivotally rotates from said first open position to said second closed position, said disengaging means mounted on said lever arm.

2. A clamping device as claimed in claim 1 further comprising:

means for selectively engaging said clamping means such that when said selective engaging means is in a first position, said clamping means is prevented from clamping the metal sheet and when said selective engaging means is in a second position, said clamping means is operative to clamp a metal sheet in said opening.

3. A clamping device as claimed in claim 2, wherein said clamping means further comprises:

a spring return member pivotally mounted adjacent to said cam member, said spring return member further comprising:

a housing have one chamber and an opposite chamber, each of said one and opposite chambers having an open end, an opposite closed end and a cavity formed between said open and closed ends, said open end of said one chamber facing said open end of said opposite chamber, said closed end of said one chamber further being pivotally mounted to said first portion, said opposite chamber and said one chamber further having an outer periphery;

a telescopic rod member mounted within said cavity of said one chamber and said cavity of said opposite chamber, said rod member having a first end and a second end opposite said first end, said first end of said rod member further being mounted to said closed end of said one chamber, said second end of said rod member further being mounted to said closed end of said opposite chamber; and a biasing member centrally located within said cavity of said one chamber and said cavity of said opposite chamber and around said telescopic rod, said biasing member having one end and an opposite end, said one end of said biasing member mounted to said closed end of said one chamber and said opposite end of said biasing member mounted to said closed end of said opposite chamber.

4. A clamping device as claimed in claim 3, wherein said clamping means further comprises:

a pair of link members mounted to said periphery of said opposite chamber, each of said pair of link members having a first end and an opposite end, one of said opposite ends of said pair of link members further being mounted to said periphery of said opposite chamber in spaced relationship opposite to the other of said opposite ends of said pair of link members, each of said first ends of said pair of link members further being pivotably mounted to said opposite leg of said cam member.

5. A clamping device as claimed in claim 4 further comprising:

means for pivotally biasing said adjustable grip portion of said cam member from said first open position to said second closed position.

6. A clamping device as claimed in claim 5, said clamping means further comprises:

a stop groove mounted on said first portion, said stop groove having an arcuate shaped profile; and means for slidably connecting said closed end of said one chamber of said housing to said arcuate shaped profile when said housing is rotated to said second position such that when said adjustable jaw portion is rotated into said second closed position, said leg portion of said cam member pushes said pair of link members to separate said opposite chamber from said one chamber to longitudinally elongate said biasing member and said telescopic member whereby said slidable connecting means is guided along said arcuate shaped profile.

7. A clamping device as claimed in claim 6 further comprising a grip member mounted in said second flange and facing said first flange.

8. A clamping device as claimed in claim 7, wherein said grip member and said adjustable grip portion are notched.

9. A clamping device as claimed in claim 8, wherein said grip member is slidably mounted in said second flange.

10. A clamping device as claimed in claim 6 wherein said second flange has an elongated blind hole facing said first flange.

11. A clamping device as claimed in claim 10 further comprising:

a grip member slidably mounted in said elongated blind hole; and means for adjustably securing said grip member in said elongated blind hole.

12. A clamping device as claimed in claim 11, wherein said grip member further comprises:

a plate member mounted in said elongated blind hole, said plate member having a central hole therethrough;

a clamping face member pivotably mounted adjacent to said plate member, said clamping face having a central recessed hole therethrough; and a rod member engaging said central recessed hole in said clamping face member, said rod member further being threadably engaged in said central hole in said plate member so as to pivotably rotate said clamping face member about said rod member.

13. A clamping device as claimed in claim 12 further comprising:

a cover member attached to but spaced away from said first portion, said cover member further covering said cam member and said clamping means to protect said cam member and said clamping means from damage.

14. A tong device to lift and handle metal sheets, said device comprising:

a body member having a first portion, a second portion slidably mounted adjacent to said first portion, said first portion having a first flange, said second portion having a second flange opposite but spaced away from said first flange, said first and second flanges defining an opening therebetween for receiving metal sheets therein;

a first pin mounted to said first portion;

a cam member rotatably attached to said first pin to pivotally rotate said cam member into said opening between said first and second flanges from a first open position to a second closed position, said cam member having an adjustable grip portion, at least one projection opposite said adjustable grip portion, a recess around said first pin, a shoulder on said cam member adjacent to said recess and a boss on said first portion adjacent to said first pin;

means mounted to said first portion and extending into said opening for engaging said cam member to position said cam member in said first open position and for disengaging said cam member when the sheet metal rotates said engaging means to position said cam member in said second closed position; and means for clamping the metal sheet in said opening when said adjustable grip portion of said cam member is rotated to said second closed position to clamp the metal sheet between said second flange and said adjustable grip portion so as to adjustably clamp the metal sheet in direct proportion to the thickness of the metal sheet to be lifted without damaging the metal sheet, said clamping means mounted to said first portion.

15. A tong device as described in claim 14 further comprising:

a cover member attached to but spaced away from said first portion, said cover member further covering said cam member and said clamping means to protect said cam member and said clamping means from damage.

16. A tong device as claimed in claim 14, wherein said engaging means further comprising:

a first lug mounted to said adjustable grip portion;

a second pin mounted to said first portion; and a first lever arm rotatably attached to said second pin, said first lever arm having a notched portion and a handle extending longitudinally from said second pin, said notched portion further engaging said first lug to lock said adjustable grip portion of said cam member in said first open position when said handle is rotated about said second pin to extend into said opening toward said second flange.

17. A tong device as claimed in claim 16, further comprising:

a second lever arm mounted adjacent to said cam member, said second lever arm having a first leg portion and a second leg portion spaced from said first leg portion, said first and second leg portions being rotatably mounted to said first pin and further orienting said cam member between said first and second leg portions.

18. A tong device as claimed in claim 17, wherein said clamping means further comprises:

a first helical biasing member coiled around said first pin, said first helical biasing member having one end and a second end, said one end of said first helical member mounted to said first portion, said second end of said first helical member mounted within said recess and against said shoulder in said cam member so as to bias said cam member to said second closed position;

a second lug rigidly mounted to said first portion adjacent to but spaced away from said first pin;

a second helical biasing member coiled around said boss on said cam member to grip said cam member when said second biasing member is stretched, said second helical biasing member having one end and a second end, said first end of said second helical member mounted to said second lug, said second end of said second helical member wrapped around said first leg portion of said second lever arm; and a third helical biasing member coiled around said second pin, said third helical member having one end and a second end, said one end of said third helical member attached to said second lug, said second end of said third helical member wrapped around said first lever arm to bias said first lever arm so as to engage said first lug on said adjustable grip portion of said cam member whereby when said cam member is locked into said first open position by said first lever arm, said cam member is biased to rotate said cam member into said second closed position by said first helical biasing member and said cam member is prevented from rotating into said second closed position by said notched portion of said first lever arm engaging said first lug to lock said adjustable grip portion of said cam member in said first open position and when a metal sheet is inserted into said opening between said first and second flanges and the edge of the metal sheet engages said handle of said first lever arm and overcomes the bias of said third helical biasing member in order to rotate said first lever arm so that said notched portion disengages from said first lug to permit said first helical biasing member to rotate said adjustable grip portion of said cam member into said second closed position to clamp the metal sheet between said first flange and said adjustable grip portion and to release the metal sheet from between said first flange and said adjustable grip portion, said second lever arm further being rotated about said first pin to engage said at least one projection on said cam member to rotate said adjustable grip portion from said second closed position to said first open position thereby releasing the metal sheet regardless of the biasing forces of said first and second helical biasing members.

* * * * *

UNITED STATES PATENT AND TRADEMARK OFFICE

CERTIFICATE OF CORRECTION

PATENT NO. : 4,327,944

DATED : May 4, 1982

INVENTOR(S) : Charles Langloy

It is certified that error appears in the above-identified patent and that said Letters Patent is hereby corrected as shown below:

Column 1, line 9, delete "tongs" and insert --- tong ---.

Column 2, line 11, delete "operation" and insert --- operator ---.

Column 6, line 3, after the word "forming" insert --- the ---.

Signed and Sealed this

*Twenty-fourth* Day of *May 1983*

[SEAL]

*Attest:*

DONALD J. QUIGG

*Attesting Officer* *Acting Commissioner of Patents and Trademarks*